US007220351B1

(12) United States Patent
Pontier et al.

(10) Patent No.: US 7,220,351 B1
(45) **Date of Patent: *May 22, 2007**

(54) METHOD AND DEVICE FOR CATALYTIC CRACKING COMPRISING IN PARALLEL AT LEAST AN UPFLOW REACTOR AND AT LEAST A DOWNFLOW REACTOR

(75) Inventors: Renaud Pontier, Vienne (FR); Patrick Leroy, Lyons (FR); Jean-Paul Lepage, Rueil Malmaison Cedex (FR); Marcelin Espeillac, Viroflay (FR)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 705 days.

This patent is subject to a terminal disclaimer.

(21) Appl. No.: 10/149,597

(22) PCT Filed: Nov. 28, 2000

(86) PCT No.: PCT/FR00/03315

§ 371 (c)(1),
(2), (4) Date: Dec. 11, 2002

(87) PCT Pub. No.: WO01/44409

PCT Pub. Date: Jun. 21, 2001

(30) Foreign Application Priority Data

Dec. 14, 1999 (FR) ..... 99 15747

(51) Int. Cl.
*C10G 11/00* (2006.01)
*C10G 51/06* (2006.01)

(52) U.S. Cl. ..... 208/113; 208/72; 208/78; 422/139; 422/144; 422/145; 422/147

(58) Field of Classification Search ..... 208/72, 208/78, 113; 422/139, 144, 145, 147
See application file for complete search history.

(56) References Cited

U.S. PATENT DOCUMENTS

| | | | | |
|---|---|---|---|---|
| 4,116,814 | A | 9/1978 | Zahner | |
| 4,814,067 | A * | 3/1989 | Gartside et al. | 208/127 |
| 4,873,389 | A * | 10/1989 | Avidan et al. | 585/533 |
| 4,883,583 | A * | 11/1989 | Mauleon et al. | 208/113 |
| 5,009,769 | A | 4/1991 | Goelzer | |
| 5,126,036 | A * | 6/1992 | Owen | 208/113 |
| 5,344,554 | A * | 9/1994 | Pontier et al. | 208/164 |
| 5,435,906 | A * | 7/1995 | Johnson et al. | 208/78 |
| 5,565,176 | A * | 10/1996 | Johnson et al. | 422/144 |
| 6,641,715 | B1 * | 11/2003 | Gauthier | 208/78 |

FOREIGN PATENT DOCUMENTS

FR 2785907 5/2000

* cited by examiner

*Primary Examiner*—Glenn Caldarola
*Assistant Examiner*—John Douglas
(74) *Attorney, Agent, or Firm*—Millen, White, Zelano & Branigan, P.C.

(57) ABSTRACT

An apparatus and a process for catalytic cracking of a hydrocarbon feed is described, carried out in at least two reaction zones, one (30) operating in catalyst riser mode, wherein the feed and catalyst from regeneration zone (3) are circulated from bottom to top, the first gases produced are separated from the coked catalyst in a first separation zone (38), the catalyst is stripped (40), a first cracking and stripping effluent (42) is recovered and the coked catalyst is recycled (45) to the regeneration zone. Catalyst (12) from regeneration zone (3) and a hydrocarbon feed (19) are introduced into the upper portion of a dropper reaction zone (16), the catalyst and feed being circulated from top to bottom, the coked catalyst is separated from the second gases produced in a second separation zone (20), the second gases (24) produced are recovered and the coked catalyst is recycled (25) to the regeneration zone.

21 Claims, 1 Drawing Sheet

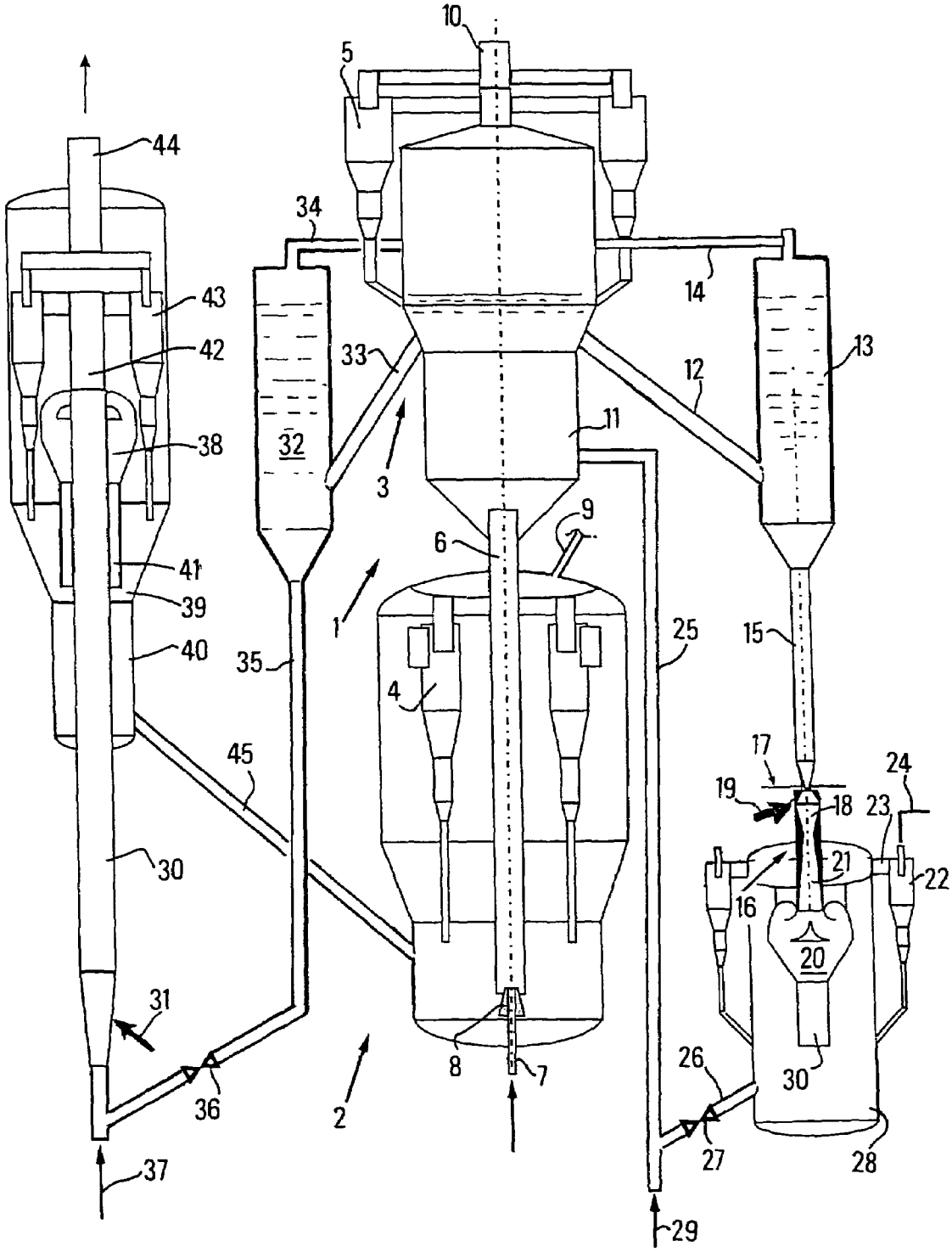
10
5
44
34
14
43
42
33
13
12
38
32
11
3
9
6
41
39
1
25
15
40
35
4
17
24
45
19
18
23
21
22
30
16
20
31
8
7
26
30
36
2
27
28
37
29

METHOD AND DEVICE FOR CATALYTIC CRACKING COMPRISING IN PARALLEL AT LEAST AN UPFLOW REACTOR AND AT LEAST A DOWNFLOW REACTOR

The present invention relates to an entrained bed catalytic cracking (FCC) process and apparatus, comprising reactors in parallel comprising at least one dropper reactor and at least one riser reactor for the catalyst from at least one regeneration zone.

Refining now places more emphasis on the flexibility of units as regards the feeds to be treated and also as regards the polyvalency of the effluents produced.

Thus FCC has had to evolve in order to accept ever heavier feeds (Conradson carbon up to 10 and $d_4^{15}$ up to 1.0, for example) and at the same time its gasoline cut yield has had to increase; the propylene yield too has had to rise as it is more in demand in the petrochemicals industry.

The specific characteristics of catalytic cracking units comprising double regeneration with injection of the feed in the form of fine droplets satisfied the need to use heavy cuts.

More recently, a catcooler exchanger module has been added to such a unit. The heat extracted by this unit enables feeds with no upper limit to the Conradson carbon to be treated.

Again in the context of treating a heavy feed, the concept of a dropper reactor with a short residence time (0.1 to 1 second) has been developed and patented, enabling severe cracking conditions to be used (for example a high temperature up to 650° C. and large catalyst circulation rates—weight ratio of catalyst to feed, or C/O, of 10 to 20). Severe cracking conditions can maximise conversion. However, for good selectivity, it is vital to control and limit the residence time of the hydrocarbons in the reactor to prevent thermal degradation reactions from becoming overwhelming (excessive coke production, loss of upgradeable products by overcracking). Contact between the hydrocarbons and the catalyst must be carried out correctly with a limited contact time between the catalyst and the hydrocarbons. The dropper reactor, combined with a suitable mixing system, such as that described in PCT patent application PCT/FR97/01627, can optimise the selectivities for upgradeable products (LPG, gasoline) by minimizing non upgradeable products such as coke and dry gases compared with a conventional technology.

To satisfy the flexibility aim, the concept of combining a traditional riser with a dropper with a short residence time has emerged. French patent application FR98/14319 describes a sequence of a dropper and a riser in series. It describes in detail the advantages of a second reactor that is operated under very different temperature conditions and C/O of the principal riser: in particular, this second reactor advantageously represents an additional capacity for treating a heavy feed by producing a minimum quantity of coke with respect to a conventional reactor; it also becomes possible to crack certain undesirable cuts (recycles) from the principal riser (low upgrading or cuts not satisfying certain specifications such as sulphur or aromatics content) to maximise the yield of upgradeable cuts (LPG, gasoline).

In one example of that patent, fresh feed is introduced into the bottom of the riser and the LCO produced from the riser is introduced into the dropper as the feed. Such a configuration can maximise the gasoline yield by exhausting the LCO under relatively severe cracking conditions.

However, the disadvantage of that system with a dropper and riser in series is that for a large dropper feed capacity, the riser reactor works with a non negligible quantity of catalyst that has been partially deactivated by its passage through the dropper (deactivation originating from coke deposits on the catalyst). This reduces the efficiency and the full potential of such a combination cannot be achieved.

The other configuration, patented by Stone and Webster, is that consisting of implanting two risers in parallel using regenerated catalyst in a common regeneration zone. Several types of recycle connections are possible between the two risers, but in this case the cracking conditions are very close (C/O, outlet temperature and residence time) which means that a genuinely refractory cut amenable to severe cracking conditions (for example HCO) cannot be treated in just one of the risers.

U.S. Pat. No. 5,009,769 described a unit comprising two riser catalytic reactors operating in parallel, in which regenerated catalyst circulates in a regeneration zone comprising two regenerators. Such a unit would be adapted to treat a wide variety of feeds but it functions under substantially identical catalyst circulation conditions (C/O=5 to 10 and residence time of 1 to 4 s for the first reactor and C/O=3 to 12 and residence time of 1 to 5 s for the second reactor). Under these conditions, the range of products obtained by each of the two reactors is substantially the same.

U.S. Pat. No. 4,116,814 illustrates the case of two riser reactors in parallel, again, connected to a particle regenerator.

The idea of the present patent is to extract all of the potential of a parallel combination of a riser operating under conventional cracking conditions (for example C/O of 5 to 7; outlet temperature of 510° C. to 530° C.; residence time 1 to 2 s) and a dropper operating under severe cracking conditions (for example C/O of 10 to 20; outlet temperature 560° C. to 620° C.; residence time 0.2 to 0.5 s). This combination enables the HCO or LCO produced in the riser to be recycled, i.e., refractory feeds that are difficult to crack, to maximise gasoline production. It can also maximise the production of olefins and in particular propylene by recycling the gasoline or only a fraction of the gasoline (heavy or light) produced in the riser to the dropper.

One aim of the invention is to overcome the disadvantages of the prior art.

A further aim is to crack both heavy hydrocarbons and light hydrocarbons under reaction conditions that are severe in a reactor adapted to those conditions, namely the dropper, and under much less severe in a riser reactor to encourage the formation of very different products satisfying the requirements of each reactor type.

It is thus possible to obtain simultaneously, for example, more propylene using a dropper reactor operating under severe catalytic cracking conditions and more gasoline using a riser reactor operating under less severe cracking conditions, economically, from a cracking unit comprising at least one catalyst regeneration step and the combination of said reactors used in parallel on at least one regenerator.

More precisely, the invention concerns a process for entrained bed or fluidised bed catalytic cracking of at least one hydrocarbon feed in at least two reaction zones, at least one being a riser, into which the feed and catalyst from at least one regeneration zone are introduced into the lower portion of the riser reaction zone, the feed and catalyst are circulated from bottom to top in said zone, the first gases produced are separated from the coked catalyst in a first separation zone, the catalyst is stripped using a stripping gas, a first cracking and stripping effluent is recovered and the coked catalyst is recycled to the regeneration zone and at least a portion thereof is regenerated using an oxygen-containing gas, the process being characterized in that catalyst from at least one regeneration zone and a hydrocarbon feed are introduced into the upper portion of at least one dropper reaction zone, the catalyst and said feed are circulated from top to bottom under suitable conditions, the coked catalyst is separated from the second gases produced in a second separation zone, the second gases produced are recovered and the coked catalyst is recycled to the regeneration zone.

In accordance with one characteristic of the process, the temperature of the catalyst at the outlet from the dropper reactor is higher than that at the outlet from the riser reactor.

In accordance with a further advantageous characteristic, the catalyst from the second separation zone is stripped using a recycle gas that is normally steam and the resulting hydrocarbons are generally recovered with the cracking gases.

Preferably, the coked catalyst is regenerated in two consecutive regeneration zones, each evacuating its combustion gas resulting from regeneration of the coked catalyst. The catalyst to be regenerated from the first separation zone is introduced into a first regeneration zone operating at a suitable temperature, the at least partially regenerated catalyst being sent to the second regeneration zone operating at a higher temperature, and the regenerated catalyst from the second regeneration zone is introduced into the riser reaction zone and into the dropper reaction zone.

The coked catalyst from the second separation zone can be recycled to the first regeneration zone either by gravity flow, generally into the dense zone, or by flow using a rising column comprising fluidising air as the driving force (lift), generally into the dilute zone of the first regeneration zone.

It may be advantageous to recycle the catalyst from the second separation zone into the second regeneration zone using a lift, either into the dense zone or into the dilute zone.

The hydrocarbon feed or each of the feeds, if different, can be introduced into the riser reaction zone and into the dropper reaction zone by co-current injection with the flow of the catalyst or counter-current thereto, or counter-current for one and co-current for the other. However, counter-current injection into the two zones appears to be preferable for better vaporisation of the droplets introduced.

The operating conditions for catalytic cracking of the feeds are usually as follows:

- in the riser reaction zone (AR):
  - catalyst temperature (AR outlet): 480-600° C., preferably 500-550° C.;
  - catalyst/feed (C/O): 4-9, preferably 5-7;
  - residence time: 0.5–4 s, preferably 1-2 s;
- in the dropper reaction zone (DR):
  - catalyst temperature (DR outlet): 500-650° C., preferably 560-620° C.;
  - catalyst/feed (C/O): 8-20, preferably 10-15;
  - residence time: 0.1-2 s, preferably 0.2-1 s.

The feed supplying each of the reaction zones can be an uncracked, i.e., fresh feed, a recycle of a portion of the products from downstream fractionation, or a mixture of the two.

The feed from one of the reaction zones can either be heavy or lighter than that circulating in the other zone. More particularly, the feed from the riser reaction zone can be a vacuum distillate or an atmospheric residue or a recycle of a portion of the products from the dropper reaction zone and the feed for the dropper zone is an uncracked feed or a reaction of a portion of the products from the riser reaction zone, preferably a gasoline cut or an LCO cut.

In accordance with a characteristic of the process, the flow rate of the feed, for example the recycle (LCO, HCO or gasoline cut) circulating in the dropper reactor can represent less than 50% by weight of the flow rate of the feed to be converted in the riser reaction zone.

The configuration of the present invention has the following advantages:

- the possibility of treating, via the dropper loop, any fresh or recycled feed under severe cracking conditions independent of the cracking conditions of the riser;
- the operative simplicity of the dropper loop as it is independent of the riser loop;
- the simplicity of use of the dropper loop as it can be placed anywhere around the regenerator, to satisfy the pressure balance. This would be practically impossible to carry out with a second riser, parallel to the first as the pressure balance in that case imposes a minimum height, and thus a residence time that can fall to the typical values of a dropper (lower than the second). In other words, in practice it is very difficult to genuinely differentiate the cracking conditions of two risers operating in parallel;
- the dropper loop can be adapted to the majority of existing cracking units, to one or to two regenerators and/or with a separation, stripping and catalyst transfer apparatus that is the most suitable for the client's demands;
- optimising the selectivities for upgradeable products (LPG, gasoline) using the technology of the dropper reactor by minimising the selectivities for non upgradeable products such as coke and dry gases compared with a conventional apparatus while maximising conversion due to the production of very severe conditions in the dropper;
- each reactor (dropper, riser) operates with freshly regenerated catalyst;
- the operating conditions of each reactor are independent of each other, in particular as regards the C/O, which is not the case for a series configuration;
- there is no problem regulating the cracking conditions for each reactor as regards the reactor outlet temperature since there is no coupling, as is the case for reactors configured in series;
- production of a catalyst cooling effect due to the dropper loop. For a given feed, from a certain level of circulation in the dropper (C/O), there is a heat extraction effect, i.e., a reduction in the temperatures in the regenerator, or in the first or second regenerator if the regeneration structure is two-stage, depending on the regenerator to which the coked catalyst from the dropper is returned.

The dropper reactor apparatus can minimise the quantity of coke formed. This results in a much lower amount of coke on the catalyst than in the equivalent riser reactor. Combined with the suitable operating conditions where catalyst circulation is higher with respect to the same quantity of feed (high C/O), the amount of coke is very significantly reduced such that the amount of heat released by combustion of this additional coke in the regenerator(s) is substantially lower than the quantity of heat consumed by vaporisation of the feed and the heat of reaction in the dropper reactor. Overall, the catalyst on the regeneration side is cooled with respect to the prior art situation comprising a single traditional riser.

This heat extraction effect, which can be obtained in an equivalent manner by a heat exchanger on the regeneration side (catcooler) or by vaporisation of a practically chemically inert recycle (MTC) downstream of the feed injection in the direction of flow of the catalyst in a riser or dropper reactor, can either allow feeds with a higher Conradson Carbon number to be treated, or the feed flow rate can be increased, or the temperature reduction in the regenerator(s) can be exploited to increase the circulation of the catalyst (C/O) in the riser and the dropper. The heat required for reaction and vaporisation on the reaction side is supplied by the regenerated catalyst, heated by combustion of coke in the regenerator(s). In order to maintain the reactor outlet temperature constant, the heat extraction effect requires an increase in the circulation of the catalyst with a constant feed flow rate and thus benefits from better catalytic activity (more active sites). More refractory feeds can be treated in the dropper.

For all of these reasons, the combination of a riser and a dropper in parallel on a common regeneration apparatus is of great importance, both when renovating existing units (revamping) and in constructing new units.

The invention also concerns an apparatus for entrained or fluidised bed catalytic cracking of a hydrocarbon feed, comprising:

- at least one substantially vertical riser reactor with a lower inlet and an upper outlet;
- a first means for supplying regenerated catalyst connected to at least one coked catalyst regenerator and connected to said lower inlet;
- a first means for supplying feed, disposed above the lower inlet to the riser reactor;
- a first chamber for separating coked catalyst from a first gas phase, connected to the upper outlet from the riser reactor, said separating chamber comprising a stripping chamber for the catalyst and having an upper outlet for gas phase and a lower outlet for coked and stripped catalyst, said lower outlet being connected to the catalyst regenerator via first catalyst recycling means;
- the apparatus being characterized in that it comprises at least one substantially vertical dropper reactor having an upper inlet and a lower outlet;
- a second means for supplying regenerated catalyst connected to said coked catalyst regenerator and connected to said upper inlet of said dropper reactor;
- a second means for supplying feed disposed below said second supply means;
- a second chamber for separating coked catalyst from a second gas phase connected to the lower outlet of the dropper reactor and having an outlet for the second gas phase and an outlet for coked catalyst, and second means for recycling coked catalyst connected to said catalyst outlet and the second separation chamber and connected to the regenerator.

In a variation of the apparatus, the second chamber for separating catalyst from the cracking effluents may not comprise a stripping chamber. In this case, pre-stripping means, for example steam pre-stripping means, can be introduced into the chamber for separating and steam can be evacuated with the cracking and pre-stripping effluents.

In a further variation, the second separation chamber comprises a chamber for stripping catalyst with injection of stripping vapour, in communication therewith, as described, for example, in the Applicant's patent application FR-98/09672, hereby incorporated by reference. The cracking and stripping effluents are generally evacuated using common means.

In a further advantageous characteristic of the apparatus, it comprises two superimposed coked catalyst regenerators, the second being located above the first, means for circulating the catalyst from the first regenerator to the second regenerator. Said first and second catalyst supply means are connected to the second regenerator and the lower outlet from the first separation chamber is connected to the first regenerator via the first recycling means.

The invention will be better understood from the accompanying figure, which illustrates a particularly advantageous embodiment of the apparatus comprising two superimposed catalyst regenerators, connected in parallel to two catalytic cracking reactors, one in riser mode, and the other in dropper mode.

In the Figure, a coked catalyst regeneration zone (1) comprises two superimposed regeneration chambers (2) and (3) in which the catalyst is regenerated in a fluidised bed, air being introduced into the bottom of each chamber by means that are not shown in the Figure. Each chamber comprises its own dust collection means (4,5) (cyclones) and means (9, 10) for evacuating coke combustion effluents. The pressure in each chamber (2) and (3) can be controlled by valves located on the lines for evacuating at least partially dedusted combustion effluents. The catalyst is transported between the two chambers using a lift (6). Air, generally introduced at a sufficient rate into the bottom via an injector (7), can transport the catalyst between the two chambers. Typically, the proportion of air necessary for regeneration is 30% to 70% in the lower chamber (2) operating at a lower temperature (for example 670° C.) and 15% to 40% in the upper chamber (3) operating at a higher temperature (for example 770° C.), 5% to 20% of the air circulating in the lift to transport the catalyst. A plug valve type solids valve (8) can control the flow rate circulating between chambers (2) and (3).

The substantially regenerated catalyst from the second regenerator located above the first (3) is sent from a dense bed (11) to a stripper drum (13) via a line (12) inclined at an angle normally in the range 30 to 70 degrees to the horizontal. In drum (13), circulation of the catalyst is slowed to enable any gas bubbles to be evacuated to the second regeneration chamber (3) via a pressure equilibration line (14). The catalyst is then accelerated and descends through a transfer tube (15) to the inlet to a dropper reactor (16). During the whole of its trajectory from the regeneration chamber, the catalyst is maintained in its fluidised state by adding small quantities of gas throughout transport. If the catalyst is thus maintained in the fluidised state at the inlet to the dropper, this can produce a pressure higher than that of the fumes from the external cyclones (5).

The dropper (16) comprises means for introducing regenerated catalyst (17) that can be a valve for solids, an orifice or simply the opening of a line, in a contact zone (18) located beneath valve (17), where the catalyst meets the hydrocarbon feed, for example in a counter-current, introduced via injectors (19), generally constituted by atomizers where the feed is finely divided into droplets by the introduction of supplemental fluids such as steam. The catalyst introduction means are located above the feed introduction means. Between the contact zone (18) and the means for separating the hydrocarbons from the catalyst (20), a substantially elongate reaction zone (21) can optionally be located, shown vertically in the figure, but this is not exclusive. The mean residence time for hydrocarbons in zones (18) and (21) is, for example less than 650 ms, preferably in the range 50 to 500 ms. The dropper effluents are then separated in a separator (20), for example as described in French application FR-98/09672, hereby incorporated by reference, where the residence time must be limited by a maximum. The gaseous effluents (cracked gases) of the separator can then undergo a supplemental dust collection step via cyclones, for example external cyclones (22) located downstream in a line (23). These gaseous effluents (cracked gases) are evacuated via a line (24). It is also possible to chill the gaseous effluents, to limit thermal product degradation, by injecting liquid hydrocarbons, for example, into the effluent leaving the cyclones (22) via line (24) or directly at the outlet for cracked gases from the separator (20) upstream of said cyclones. The catalyst separated in separator (20) is then either re-injected directly at the base of a rising column (25) via a line (26) where a valve (27) controls the flow rate in relation to the outlet temperature from the dropper, or introduced into a fluidised bed (28) for stripping, via a line or opening (30). The catalyst in the fluidized bed (28) is thus stripped (contact with a light gas such as steam, nitrogen, ammonia, hydrogen or even hydrocarbons containing less than 3 carbon atoms) via means that have been described in the prior art, before being transferred to the riser column (25) via line (26). The gaseous stripping effluents are generally evacuated from the fluidized bed (28) via the same means (23, 22) that can evacuate gaseous effluents from the dropper (16) via line (24). The coked catalyst is driven upwards using a fluidization gas (29) into the dense fluidized bed of the second regenerator (3).

The riser reaction zone (30) is a substantially elongate tubular zone, numerous examples of which have been described in the prior art. In the example given in the figure, the hydrocarbon feed is introduced via means (31), generally constituted by atomisers where the feed is finely divided into droplets, generally by introducing auxiliary fluids such as steam, introduced through means (31). The catalyst introduction means are located below the feed introduction means. The feed is introduced above the catalyst inlet.

These means for introducing catalyst into the riser (30) comprise a stripper drum (32) similar to that (13) supplying the dropper, connected to the dense bed of the second catalyst regenerator (3) via a line (33) inclined substantially at the same angle as that of line (12). The drum (32) is also connected to the dilute fluidised bed via a pressure equilibration line (34). At the bottom of the drum, a line that it initially vertical then inclined is connected to the lower portion of the riser. A control valve (36) disposed on the line (35) regulates the flow rate of the regenerated catalyst at the riser inlet as a function of the catalyst outlet temperature and the effluents at the upper portion of the riser. Fluidisation gas introduced at the bottom of the riser via injection means (37) cause the catalyst to circulate in a co-current with the feed in the riser. In a variation (not shown), the feed may be injected as a counter-current to the flow, towards the bottom of the riser. Above the feed injectors, a light hydrocarbon cut or a heavier cut (LCO or HCO, for example), from downstream distillation of the cracking effluents from the riser, can be injected into this riser. The cut introduced can represent 10% to 50% by weight of the feed introduced into the riser and can contribute to maximise the gasoline production.

The cracking reaction occurs in the riser. The cracking effluents are then separated in a separator (38), for example as described in PCT patent application PCT/FR 98/01866, hereby incorporated by reference. The catalyst from the separation is then introduced into a fluidised bed (39) of a stripping chamber (40) located below the separator, through lines (41) or openings. The catalyst in the chamber (39, 40) then undergoes stripping (contact with a light gas such as steam, nitrogen, ammonia, hydrogen or even hydrocarbons containing less than 3 carbon atoms) using means that are not shown in the figure.

The stripped catalyst is then transferred to the dense bed of the first regeneration chamber (2) via line (45). The gaseous cracking and stripping effluents separated in separator (38) are evacuated through a line (42) to a secondary separator (43) such as a cyclone, for example inside the chamber (39, 40) before being directed towards the downstream fractionation section via a line (44).

By way of example and to illustrate the invention, the results obtained from an industrial unit provided with a conventional riser reactor treating a heavy feed and provided with a double regeneration system as described in the figure was compared with the results obtained by inserting a dropper reactor in parallel, this new reactor then being fed with two cuts, different in each example, produced by the riser reactor.

The results of this comparison are based on the industrial results obtained with a unit provided with the riser reactor and pilot tests carried out by cracking the cut under consideration. The new conditions for satisfying the thermal balance of the unit as a whole were re-calculated using a model of the process.

The fresh feed (vacuum distillate) had the following characteristics:

| | |
|---|---|
| density $d^{15}$: | 0.937; |
| sulphur content: | 0.5%; |
| Conradson carbon: | 5.8% |

It was injected into the bottom of a riser supplied with catalyst from a double regeneration apparatus, as shown in the accompanying figure. This catalyst, based on a Y zeolite, had the following characteristics:

| | |
|---|---|
| Grain size: | 70 micrometers; |
| BET specific surface area ($m^2/g$): | 146; |
| Zeolitic surface area ($m^2/g$): | 111 |
| Matrix surface area ($m^2/g$): | 35; |

The catalyst originated from the second regenerator.

The cracking effluents were distilled and a portion of the HCO cut obtained and all of a heavy gasoline cut (170° C.-200° C.) were recycled to the riser. This recycle, constituted by 49.3% of HCO and 50.7% of heavy gasoline cut, represented 27.1% by weight of the fresh feed to the riser. A supplemental cut was recycled as the feed to the dropper that was in turn fed with catalyst from the second regenerator.

The coked catalyst from the stripper connected to the riser was recycled to the dense phase of the first regenerator while that from the stripper connected to the dropper was recycled via a lift to the dense phase of the second regenerator.

EXAMPLE 1

In this first example, 23.4% by weight of the gasoline cut produced in the riser, i.e., 10% by weight with respect to the fresh feed to the riser, was recycled to the dropper as the feed.

The conditions in the riser (ROT and recycle) were maintained by increasing the C/O of the riser.

| | | AR alone | AR + DR |
|---|---|---|---|
| FCC unit feed (FCC UF) | Kg/s | 48.08 | 48.08 |
| Hydrocarbon recycle AR | % fresh feed | 27.14 | 27.14 |
| C/O AR | — | 6.33 | 6.87 |

-continued

| | | AR alone | AR + DR |
|---|---|---|---|
| T outlet AR (ROT) | ° C. | 516 | 516 |
| T fresh feed AR | ° C. | 174 | 174 |
| T recycle AR | ° C. | 178 | 178 |
| T REG 1 | ° C. | 692 | 686 |
| T REG 2 | ° C. | 778 | 757 |
| Air used for regeneration | t/h | 173.5 | 194.1 |
| Proportion (air reg 1/total air) | % | 65.7 | 61.2 |
| C/O DR | — | — | 14.95 |
| T outlet DR | ° C. | — | 620 |
| T feed DR | ° C. | — | 35 |
| Yields | | | |
| Dry gases | % FCC UF | 4.77 | 4.94 |
| Propane | % FCC UF | 0.95 | 1.25 |
| Propylene | % FCC UF | 4.31 | 6.61 |
| C3 cut (propane + propylene) | % FCC UF | 5.26 | 7.86 |
| C4 cut | % FCC UF | 6.61 | 8.08 |
| Gasoline | % FCC UF | 42.72 | 39.51 |
| LCO | % FCC UF | 22.48 | 21.38 |
| Slurry | % FCC UF | 10.03 | 9.24 |
| Coke | % FCC UF | 8.13 | 8.99 |
| | % FCC UF | 100.0 | 100.0 |
| Conversion | % | 67.49 | 69.38 |

Note that: AR = riser reactor (residence time: 1 s);
DR = dropper reactor (residence time: 0.4 s);
REG1 = first regeneration chamber;
REG2 = second regeneration chamber It can be seen that propylene can be produced in a substantial quantity (53% or more) by true severe cracking in the dropper, while retaining a satisfactory gasoline yield. Further, the temperature of the second regenerator has fallen by 21° C. (catcooler effect). A gain in conversion of the fresh feed of 1.9% was obtained by exhaustion of the LCO and slurry.

EXAMPLE 2

In this second example, 99.7% by weight of the HCO cut (or slurry), i.e., 10% by weight with respect to the fresh feed, was recycled as a feed to the dropper.

The conditions in the riser (ROT and recycle) were maintained by augmenting the C/O of the riser.

| | | AR alone | AR + DR |
|---|---|---|---|
| FCC unit feed (FCC UF) | Kg/s | 48.08 | 48.08 |
| Hydrocarbon recycle AR | % fresh feed | 27.14 | 27.14 |
| C/O AR | — | 6.33 | 6.60 |
| T outlet AR (ROT) | ° C. | 516 | 516 |
| T fresh feed AR | ° C. | 174 | 174 |
| T recycle AR | ° C. | 178 | 178 |
| T REG 1 | ° C. | 692 | 689 |
| T REG 2 | ° C. | 778 | 767 |
| Air used for regeneration | T/h | 173.5 | 190.1 |
| Proportion (air reg 1/total air) | % | 65.7 | 61.4 |
| C/O DR | — | — | 9.7 |
| T outlet DR | ° C. | — | 603 |
| T feed DR | ° C. | — | 180 |
| Yields | | | |
| Dry gases | % FCC UF | 4.77 | 4.98 |
| Propane | % FCC UF | 0.95 | 1.10 |
| Propylene | % FCC UF | 4.31 | 4.85 |
| C3 cut (propane + propylene) | % FCC UF | 5.26 | 5.95 |
| C4 cut | % FCC UF | 6.61 | 7.48 |

-continued

| | | AR alone | AR + DR |
|---|---|---|---|
| Gasoline | % FCC UF | 42.72 | 45.07 |
| LCO | % FCC UF | 22.48 | 23.44 |
| Slurry | % FCC UF | 10.03 | 4.27 |
| Coke | % FCC UF | 8.13 | 8.81 |
| | % FCC UF | 100.0 | 100.0 |
| Conversion | % | 67.49 | 72.29 |

Note that: AR = riser reactor;
DR = dropper reactor;
REG1 = first regeneration chamber;
REG2 = second regeneration chamber It can be seen that HCO (slurry) can be converted in a substantial quantity (57% conversion) by true severe cracking in the dropper, while retaining a relatively low overall coke yield in the unit. Further, the temperature of the second regenerator has fallen by 21° C. (catcooler effect). A gain in conversion of the fresh feed of 4.8% was obtained by exhaustion of the slurry, resulting in better yields of upgradeable products (more than 1.5% of LPG and 2.3% of gasoline in addition).

The invention claimed is:

1. A process for entrained bed or fluidised bed catalytic cracking of at least one hydrocarbon feed in at least two reaction zones, at least one (30) being a riser, into which the feed (31) and catalyst (35) from at least one regeneration zone (3) are introduced into the lower portion of the riser reaction zone, the feed and catalyst are circulated from bottom to top in said zone, the first gases produced are separated from the coked catalyst in a first separation zone (38), the catalyst is stripped (40) using a stripping gas, a first cracking and stripping effluent (42) is recovered and the coked catalyst is recycled to the regeneration zone and at least a portion thereof is regenerated using an oxygen-containing gas, the process being characterized in that catalyst (12) from at least one regeneration zone (13) and a hydrocarbon feed (19) are introduced into the upper portion of at least one dropper reaction zone (16), the catalyst and said feed are circulated from top to bottom under suitable conditions, the coked catalyst is separated from the second gases produced in a second separation zone (20), the second gases produced (24) are recovered and the coked catalyst is recycled (25) to the regeneration zone said at least one riser reaction zone and said at least one dropper reactor reaction zone being in parallel and in communication with at least one common regeneration zone.

2. A process according to claim 1, in which the outlet temperature from the dropper reactor is higher than that at the outlet from the riser reactor.

3. A process according to claim 1, in which the catalyst from the second separation zone is stripped using a stripping gas.

4. A process according to claim 1, in which the catalyst is regenerated in two consecutive regeneration zones, the catalyst to be regenerated from the first separation zone is introduced into a first regeneration zone operating at a suitable temperature, the at least partially regeneration catalyst then being sent to the second regeneration zone operating at a higher temperature and the regenerated catalyst from the second regeneration zone is introduced into the riser reaction zone and into both the dropper reaction zone.

5. A process according to claim 4, wherein the catalyst from the second separation zone is recycled to the first regeneration zone.

6. A process according to claim 5, in which the catalyst is recycled to the dense zone of the first regeneration zone.

7. A process according to claim 5, in which the catalyst is recycled to the dilute zone of the first regeneration zone using a lift.

8. A process according to claim 4, in which the catalyst from the second separation zone is recycled to the second regeneration zone using a lift.

9. A process according to claim 1, in which the feeds are introduced into the riser reaction zone and into the dropper reaction zone by injection counter-current to the catalyst flow.

10. A process according to claim 1, in which the operating conditions are as follows:

in the riser reaction zone (AR):
catalyst temperature (AR outlet): 480-600° C.,
catalyst/feed (C/O): 4-9,
residence time: 0.5-4 s, in the dropper reaction zone (DR):
catalyst temperature (AR outlet): 500-650° C.,
catalyst/feed (C/O): 8-20,
a residence time: 0.1-2 s.

11. A process according to claim 1, in which the feed supplying each of the reaction zones is an uncracked feed termed a fresh feed, a recycle of a portion of the products from downstream fractionation, or a mixture of the two.

12. A process according to claim 11, in which the feed for the riser reaction zone is a vacuum distillate or an atmospheric residue or a recycle of a portion of the products from downstream fractionation and in which the feed for the dropper zone is an uncracked feed or a recycle of a portion of the products from downstream fractionation.

13. An apparatus for entrained bed or fluidised bed catalytic cracking of a hydrocarbon feed, comprising, at least one substantially vertical riser reactor (30) having a lower inlet and an upper outlet;

a first means (35) for supplying regenerated catalyst connected to at least one regenerator (3) for coked catalyst and connected to said lower inlet;

a first means (31) for supplying feed located above the lower inlet of the riser reactor;

a first chamber (38) for separating coked catalyst from a first gas phase connected to the upper outlet from the riser reactor (30), said separation chamber comprising a chamber (40) for stripping catalyst and having an upper outlet for a gas phase and a lower outlet for coked and stripped catalyst, said lower outlet being connected to the catalyst regenerator via first catalyst recycling means (45);

the apparatus being characterized in that it comprises in parallel combination with said riser reactor and in communication with a common regenerator at least one substantially vertical dropper reactor (16) having an upper inlet and a lower outlet;

a second means (12) for supplying regenerated catalyst connected to said coked catalyst regenerator (3) and connected to said upper inlet of the dropper reactor;

a second means (19) for supplying feed disposed below the second supply means (12);

a second chamber (20) for separating coked catalyst from a second gas phase connected to the lower outlet from the dropper reactor and having an outlet for the second gas phase and an outlet for coked catalyst;

and second means (25) for recycling coked catalyst connected to said catalyst outlet from the second separation means and connected to the regenerator.

14. An apparatus according to claim 13, in which the second separation chamber comprises a catalyst stripping chamber communicating therewith.

15. An apparatus according to claim 13, comprising two consecutive coked catalyst regenerators (2,3), and means for circulating the catalyst from the first regenerator (2) to the second regenerator (3), characterized in that said first and second catalyst supply means (35, 12) are connected to the second regenerator (3) and in that said lower outlet from the first separation chamber is connected to the first regenerator via first recycling means (45).

16. An apparatus according to claim 15, in which the second recycling means (2, 5) comprise a lift (29) connected to the second regenerator.

17. An apparatus according to claim 13, in which the first and second catalyst recycling means each comprise a flow regulating valve (27, 36) controlled by means for measuring the temperature of the catalyst at the outlet from the riser reactor and the dropper reactor.

18. A process according to claim 1, in which the operating conditions are as follows:

in the riser reaction zone (AR):
catalyst temperature (AR outlet): 500-550° C.;
catalyst/feed (C/O): 5-7;
residence time: 1-2 s.

in the dropper reaction zone (DR):
catalyst temperature (AR outlet): 560-620° C.;
catalyst/feed (C/O): 10-15;
residence time: 0.2-1 s.

19. A process according to claim 12, wherein the feed for the dropper zone is a gasoline cut or an LCO cut.

20. A process according to claim 1, wherein the hydrocarbon feed is fed to the dropper reaction zone at a rate, by weight, of less than 50% of the rate of the hydrocarbon feed to the riser reaction zone.

21. A process according to claim 1, wherein the feeds fed to the riser reactor zone and the dropper reactor zone are the same.

* * * * *

UNITED STATES PATENT AND TRADEMARK OFFICE

CERTIFICATE OF CORRECTION

PATENT NO. : 7,220,351 B1
APPLICATION NO. : 10/149597
DATED : May 22, 2007
INVENTOR(S) : Renaud Pontier It is certified that error appears in the above-identified patent and that said Letters Patent is hereby corrected as shown below:

On the Title page item [75], Inventors: line 2, reads “Lyons” should read -- Lyon --

Signed and Sealed this

Fourth Day of March, 2008

JON W. DUDAS
*Director of the United States Patent and Trademark Office*